US005686892A

United States Patent [19]

Smith

[11] Patent Number: 5,686,892

[45] Date of Patent: Nov. 11, 1997

[54] STOLEN PROPERTY TRACKING SYSTEM

[76] Inventor: William J. Smith, 25076 Newhall Ave., Newhall, Calif. 91321

[21] Appl. No.: 387,488

[22] Filed: Feb. 13, 1995

Related U.S. Application Data

[63] Continuation-in-part of Ser. No. 944,544, Sep. 14, 1992, abandoned.

[51] Int. Cl.[6] ..... G08B 13/14

[52] U.S. Cl. ..... 340/572; 340/574

[58] Field of Search ..... 340/572, 574, 340/825.49, 988, 539; 455/345, 88; 342/417; 364/516–517; 341/176; 109/38–39

[56] References Cited

U.S. PATENT DOCUMENTS

| | | | |
|---|---|---|---|
| 3,440,635 | 4/1969 | Hull | 340/574 X |
| 3,618,059 | 11/1971 | Allen | 340/572 X |
| 3,777,086 | 12/1973 | Riedo | 340/574 X |
| 3,922,678 | 11/1975 | Frenkel | 342/457 |
| 4,021,807 | 5/1977 | Culpepper et al. | 340/572 X |
| 4,157,540 | 6/1979 | Oros | 340/574 X |
| 4,943,803 | 7/1990 | Vrijkorte | 340/825.49 |
| 5,223,818 | 6/1993 | Polo | 340/574 |

FOREIGN PATENT DOCUMENTS

| | | | |
|---|---|---|---|
| 2137387 | 10/1984 | United Kingdom | 340/572 |

*Primary Examiner*—Thomas Mullen
*Attorney, Agent, or Firm*—Roger A. Marrs

[57] ABSTRACT

A tracking and monitoring system is disclosed herein having a stationary alert or alarm transmitter selectively and manually operated to generate an alert signal receivable by a remote monitoring receiver in a mobile vehicle. The monitoring receiver receives the alert signal and a track signal separately or simultaneously. The track signal is transmitted by a track transmitter hidden in property being stolen. Once alerted and on-track with the monitoring receiver, the mobile vehicle maintains vigil on the stolen property and closes range until apprehension can be safely arranged and performed.

8 Claims, 1 Drawing Sheet

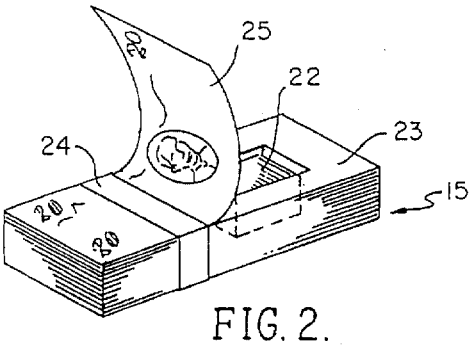
FIG. 2.
FIG. 3.
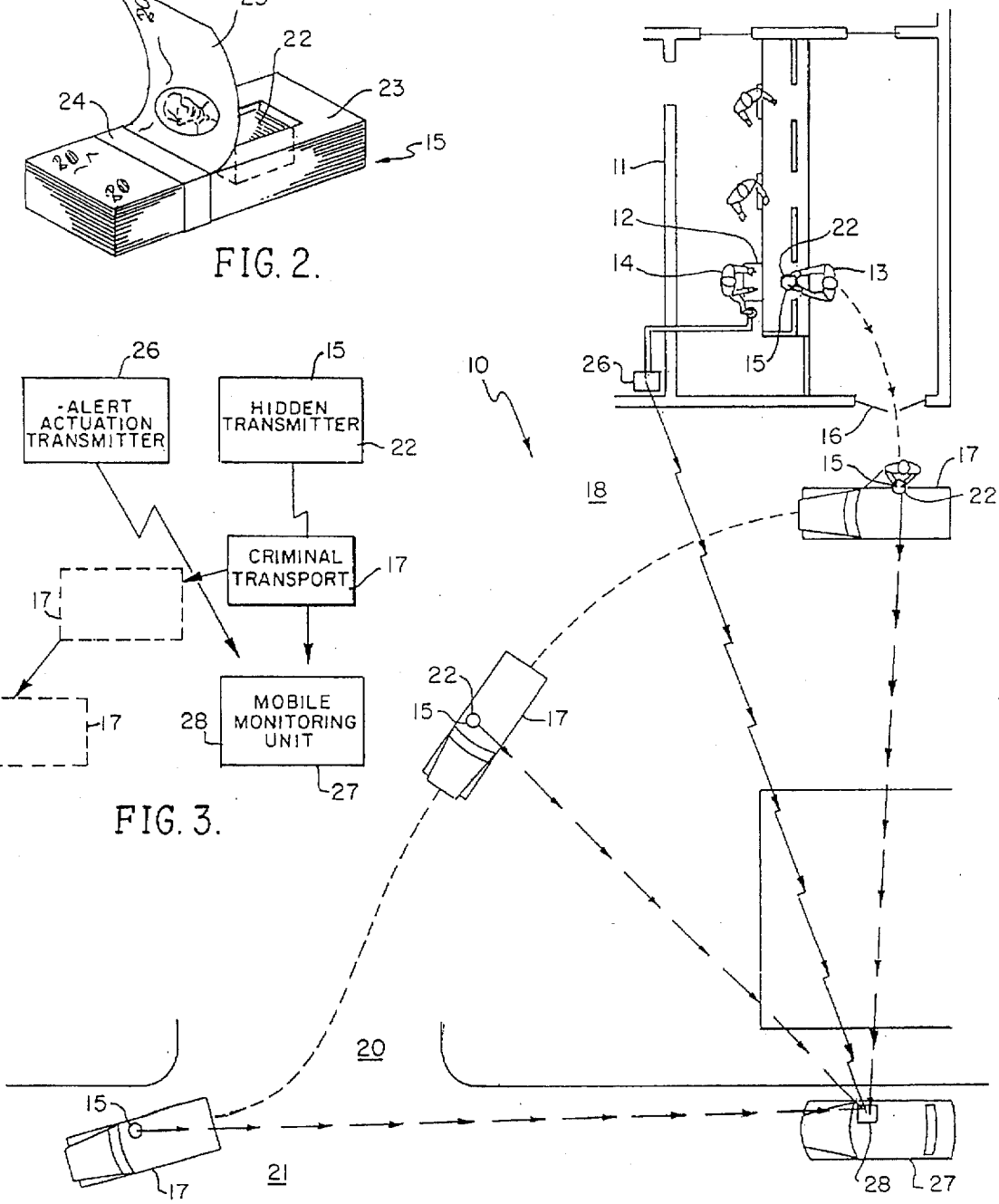
FIG. 1.

STOLEN PROPERTY TRACKING SYSTEM

This Application is a Continuation-in-Part of application Ser. No. 07-944,544 filed Sep. 14, 1992, now abandoned.

BACKGROUND OF THE INVENTION

1. Field of the Invention

The present invention relates to the field of tracking systems, and more particularly to a novel surveillance and monitoring system for tracking stolen property leading to the apprehension of perpetrators and recovery of the property.

2. Brief Description of the Prior Art

In the past, it has been the conventional practice to alert law enforcement agencies that a robbery is in progress by pressing an alarm button which employs a single transmitted signal to the agency of the robbery occurrence. U.S. Pat. No. 3,618,059 discloses such a system. This system is not preventative and upon arrival of law enforcement personnel, customers, visitors and employees are at risk during apprehension and property recovery. In some instances, it is police procedure to permit the perpetrator to leave with the stolen property so as to apprehend the perpetrator at a later time at the discretion of the police. Another prior disclosure is U.S. Pat. No. 5,223,818.

Problems and difficulties have been encountered with these systems, which stem largely from the fact that it is difficult to track the perpetrator and in some instances, the stolen property is separated from the thief which complicates property recovery as well as apprehension of the thief. In some instances, helicopters are used to track a thief's vehicle as it travels from place to place so that its current whereabouts can be determined. This system relies upon physical surveillance of the vehicle which can sometimes be obscured by clouds, fog or confusion during a night chase. During daytime, thieves are sometimes out of view, such as when passing through a tunnel, under a bridge, or passing through buildings.

Therefore, a long-standing need has existed to provide a novel surveillance and tracking system which may utilize a pair of electronic transmitters and a sole receiving equipment capable of indicating a robbery situation and which will track and provide current location of the perpetrator as well as specific location of the property stolen.

SUMMARY OF THE INVENTION

Accordingly, the above problems and difficulties are obviated by the present invention which provides a novel surveillance and tracking system for indicating a robbery occurrence and the monitoring of stolen goods until apprehension. In one form of the invention, the system provides a first stationary alarm transmitter at the robbery site which is selectively operated by a teller or the like during the occurrence of a robbery so as to generate an alert signal. The alert signal is received by a remote monitoring receiver located in a mobile vehicle, such as a police car. The system further includes a second track transmitter separate from the first alarm transmitter which is hidden in the stolen article so that a track signal is transmitted therefrom to the mobile monitoring receiver separate from the alert signal. As the stolen property is moved from place to place, its location is noted by reception of the track signal, which includes information on the current position of the perpetrator or stolen property. In some instances, a radio direction finder apparatus can assist in the location. Apprehension can be achieved at the convenience and in safety by proper law enforcement agencies.

Therefore, it is among the primary objects of the present invention to provide a novel stolen property tracking system employing separately generated alert and tracking signals which provides safety to employees, visitors and customers at a business establishment during the robbery, and which can track stolen property away from the robbery site for subsequent apprehension.

Another object of the present invention is to provide a novel stolen property tracking system which is secret and unknown to the robbery perpetrators whereby subsequent apprehension can be made in safety.

Yet another object of the present invention is to provide a novel tracking and monitoring system for locating stolen property and for determining its current geographical position by means of transmitter and receiving apparatus so that information is transferred via coded data.

Another object of the present invention is to provide a novel tracking system for locating stolen property, which can follow the geographical location of the property from the robbery site to an apprehension location at the selection made by law enforcement agencies.

A further object resides in the placement of a detectable material such as ink, fluorescent substance or nuclear powder or the like on the stolen property whereby such material can be tracked or traced by authorities.

Another object resides in a tracking and monitoring system having separate alert and tracking signal transmitters so that either transmitter can generate a separate alert signal or tracking signal independent of each other and wherein the length of time of each signal can be varied with respect to each other.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a diagrammatic drawing in plan view illustrating the stolen property tracking system incorporating the present invention;

FIG. 2 is a perspective view of a track transmitter carried and hidden in property subject to unauthorized removal from a business location; and FIG. 3 is a block diagram illustrating signal and information flow between transmitter and receiver apparatus, as employed in the system shown in FIG. 1.

DESCRIPTION OF THE PREFERRED EMBODIMENT

Referring to FIG. 1, the inventive stolen property tracking system is shown in the general direction of arrow 10 wherein numeral 11 represents a business site, such as a bank, having property which is desired and is generally kept in cash drawers, such as drawer 12. For illustrative purposes, the desired property to be stolen would be cash and generally taking the form of a stack of paper money which is bound together by a band. A robber is indicated by numeral 13 and the teller is indicated by numeral 14. Upon demand, the teller is instructed to pass the bundles of cash to the robber and such a bundle is indicated by numeral 15. The robber 13 leaves the bank 11 through doors 16 and enters his vehicle 17 in order to transport the stolen property from the business site 11. The car 17 travels in a tortuous path away from the business site and generally traverses different streets about different blocks. For example, the street first travelled is first indicated by numeral 18 while the second street is indicated by numeral 20 and the third street indicated by numeral 21.

Referring now to FIG. 2, a typical track transmitter is indicated by numeral 22 which is held in a cavity placed in a simulated stack of cash bills, as indicated by numeral 23. The stack of bills is held together by a conventional band 24 and the exterior sides of the package appear identical to the graphic representations carried on conventional money. For example, the top bill 25 is indicated as a twenty dollar bill and carries indicia signifying this value. As would be the usual practice, an unauthorized person would order the teller to place the stacks of bills into a bag which the robber would carry into the escape vehicle 17.

Referring now in detail to FIG. 3, both the alert actuation transmitter 26 that may be located at the bank site 11 and the hidden track transmitter 22 are actuated by the teller 14 during a robbery so as to indicate that a robbery is in progress. The transmitter 26 sends a short alert signal to the mobile unit 27 which is received by a monitoring unit or receiver 28 and is actuated thereby. The law enforcement personnel within the mobile unit, which may be a police car or the like, as indicated by numeral 27, are then alerted to monitor a continuous track signal. The track signal is initiated by the hidden transmitter 22 which is in the possession of the robber 13. While the booty or stolen property is in the possession of the robber, the hidden transmitter 22 continues to initiate the track signal to the receiver 28 which tracks and monitors the position of the criminal transport 17. The law enforcement agents can now arrange for interception when the situation is safe and at their convenience. The short or non-continuous alert signal from transmitter 26 need only function for a sufficient time to alert personnel in the monitoring unit 27 while the hidden transmitter 22 is intended for continuous transmission over a long time period and the receiver 28 is employed for monitoring and surveillance purposes. The receiver includes conventional circuitry and mechanism serving as a radio direction finder so that the criminal transport 17 and/or the stolen property can be located via the hidden transmitter 22.

In view of the foregoing, it can be seen that a novel tracking and surveillance system is employed with an alert signal going to the monitoring unit to alert personnel followed by reception of a tracking signal by which the receiving equipment can locate and monitor movements of stolen property.

The provision of separate alert and tracking transmitters permits the user to test either transmitter separately for maintenance or training purposes. Also, should the robber be apprehended after the alert signal has been generated, the track transmitter need not be initiated nor easier to stop without incapacitating the alert transmitter.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A stolen property tracking system comprising:

an alert actuation transmitter generating a momentary alert signal in response to a manual initiation by a victim during a robbery attempt;

a track transmitter remote from said alert actuation transmitter and disposed in and hidden in property subject to being stolen for generating a continuous track signal; and mobile means having a receiving means for independently receiving said alert and said track signal and in response to said alert signal continuously monitoring said track signal;

wherein said alert actuation transmitter is stationary; and said track transmitter is non-stationary.

2. The invention as defined in claim 1 wherein:

said receiving means tracks the location of said property when stolen by performing said monitoring of said track signal.

3. In a stolen property monitoring, tracking and recovery system in which property when stolen is transported from a deposit site to a remote location, the combination comprising:

property subject to being stolen;

a movable track transmitter visually concealed in said property for generating a continuous signal;

a mobile receiver adapted to receive and monitor said track signal and thereby track and monitor the location of said property;

a victim alarm actuated in response to a manual initiation by a victim during a robbery occurrence;

a stationary transmitter for selectively generating a momentary alert signal in response to actuation of said victim alarm; and wherein said mobile receiver is arranged to receive said alert signal to initiate said monitoring of said track signal.

4. The invention as defined in claim 3 wherein:

said property is a package with an enclosed cavity; and said track transmitter is disposed in said enclosed cavity.

5. The invention as defined in claim 4 wherein:

said mobile receiver is carried in a law enforcement vehicle.

6. The invention as defined in claim 5 wherein:

said package with an enclosed cavity is a simulated stack of monetary bills having a central cavity occupied by said track transmitter; and a top and a bottom monetary bill of said stack are employed to cover said central cavity to hide said track transmitter from visual observation.

7. The invention as defined in claim 6 wherein:

said track signal is continuously generated such that said momentary alert signal and said continuous track signal are simultaneously received by said receiver whereby said monitoring of said continuous track signal is initiated immediately upon receiving said momentary alert signal.

8. In a stolen property alerting, monitoring, tracking and recovery system in which property, when stolen, is transported from a deposit site to a remote location, the combination comprising:

property subject to being stolen;

a mobile track transmitter visually concealed in said property for generating a continuous track signal;

a victim alarm remote from said track transmitter actuated in response to a manual initiation by a victim during a robbery occurrence;

a stationary transmitter at the deposit site for selectively generating a momentary alert signal in response to actuation of said victim alarm;

said alert signal and said track signal generated independently of each other; and a mobile receiver adapted to simultaneously receive both said momentary alert signal and said continuous track signal wherein said mobile receiver is arranged to receive said momentary alert signal to initiate monitoring of only said continuous track signal.

* * * * *